US006524027B1

(12) United States Patent
Fabius

(10) Patent No.: US 6,524,027 B1
(45) Date of Patent: Feb. 25, 2003

(54) STABILIZATION SYSTEM FOR SOIL SLOPES

(75) Inventor: Mike Fabius, Thunder Bay (CA)

(73) Assignee: DST Consulting Engineers Inc., Thunder Bay (CA)

( * ) Notice: Subject to any disclaimer, the term of this patent is extended or adjusted under 35 U.S.C. 154(b) by 0 days.

(21) Appl. No.: 09/564,031

(22) Filed: May 4, 2000

(51) Int. Cl.[7] ..... E02B 3/12
(52) U.S. Cl. ..... 405/16; 405/17
(58) Field of Search ..... 405/15, 16, 17, 405/24, 284, 286, 262, 21, 19

(56) References Cited

U.S. PATENT DOCUMENTS

| | | | | | |
|---|---|---|---|---|---|
| 360,225 | A | * | 3/1887 | Kanters | 405/19 |
| 457,818 | A | * | 8/1891 | Nier | 405/19 |
| 722,445 | A | * | 3/1903 | Boynton | 405/19 |
| 763,503 | A | * | 6/1904 | McGregor | 405/19 |
| 855,584 | A | * | 6/1907 | Neale | 405/16 |
| 953,051 | A | * | 3/1910 | DeMuralt | 405/16 |
| 1,026,616 | A | * | 5/1912 | Stratton | 405/16 |
| 1,048,251 | A | * | 12/1912 | Wilkinson | 405/16 |
| 1,058,274 | A | * | 4/1913 | Tirapani | 405/19 |
| 1,066,092 | A | * | 7/1913 | Ellery | 405/19 |
| 1,358,042 | A | * | 11/1920 | Warmoth | 405/19 |
| 2,201,279 | A | * | 5/1940 | Willing | 405/16 |
| 3,716,998 | A | * | 2/1973 | Svendsen et al. | 405/19 |
| 4,504,076 | A | | 3/1985 | Bedney | |
| 5,249,893 | A | * | 10/1993 | Romanek et al. | 405/19 |
| 5,322,386 | A | * | 6/1994 | Trangsrud | 405/19 |
| 5,338,131 | A | | 8/1994 | Bestmann | |
| 5,425,597 | A | * | 6/1995 | Bestmann | 405/24 |
| 5,641,244 | A | * | 6/1997 | Bestmann | 405/16 |
| 5,702,207 | A | | 12/1997 | Hoffmann | |
| 6,048,139 | A | * | 4/2000 | Donovan, III | 405/284 |
| 6,171,022 | B1 | * | 1/2001 | Decker | 405/16 |

* cited by examiner

*Primary Examiner*—Thomas B. Will
*Assistant Examiner*—Alexandra Pechhold
(74) *Attorney, Agent, or Firm*—Adrian D. Battison; Michael R. Williams

(57) ABSTRACT

A method of stabilizing slopes of a soil embankment is provided using a stabilization system for slopes having generally less than 45 degrees of inclination from horizontal. The system comprises a plurality of soil nails which are penetrated into the slopes to provide internal soil stability and a biotechnical facing on a surface of the slope to inhibit surface erosion and shallow failure of the slope. A geosynthetic layer comprising a mat, mesh or fibrous material is laid across the slope adjacent the surface to assist in establishing vegetation thereon. A retaining wall structure is preferably mounted on the crest of the slope to extend transversely to the slope. The retaining wall structure at the crest provides a stable base for supporting the embankment shoulder.

18 Claims, 5 Drawing Sheets

STABILIZATION SYSTEM FOR SOIL SLOPES

FIELD OF THE INVENTION

This invention relates to a system of stabilising soil slopes and a method related thereto.

BACKGROUND

On steep slopes having generally less than 45 degrees of inclination to the horizontal, the prevention of soil erosion is typically accomplished by planting vegetation on the surface of the slope. The roots of the vegetation secure the soil at the surface. Vegetation alone however does not prevent large shifts of the soil.

The use of nails and other forms of anchors is known for stabilising soil on vertical or near vertical faces. Generally these nails are installed with shotcrete or precast concrete facings between the nails during the formation of the faces for retaining the soil between the nails. There is no known precedent for utilising nails on existing slopes having an inclination of less than 45 degrees.

It is an object of the present invention to provide a stabilisation system for soil slopes which incorporates internal soil slope stability with the prevention of surface soil erosion.

SUMMARY

According to one aspect of the present invention there is provided a method for stabilising soil within a slope having generally less than 45 degrees of inclination from horizontal, said method comprising:

penetrating a plurality of soil nails into the soil; and establishing vegetation adjacent a top surface of the soil, the vegetation being arranged to generate roots which penetrate through the surface into the soil.

The use of soil nails provides internal soil stability to a slope or embankment by penetrating the nail through the soil past an existing or potential failure plane. The soil nails extend transversely to existing or potential failure planes to resist internal shearing forces within the slope of soil. A cover of vegetation established onto the surface of the soil provides further stability to the slope. The vegetation established at the surface of the slope prevents erosion or shallow failure near the surface of the slopes. Additional retaining members may also be mounted along the crest of the slope by anchoring the retaining members to the slope with the soil nails to further inhibit soil erosion and shallow failure at the crest.

A biotechnical facing may be established by providing a geosynthetic layer comprising a mat, mesh or fibrous material placed over or near the soil surface before or after seeding or planting such that the vegetation is stabilised on the surface of the slope for retaining the soil adjacent the surface of the slope.

A retaining member can be mounted adjacent a crest of the slope to extend transversely thereto. The retaining member further inhibits soil erosion and shallow failure at the crest.

The retaining member may comprise an elongate plate member, wherein the method includes orienting the plate member to extend substantially perpendicularly to the surface of the soil and to project outwardly therefrom.

The method may further include filling a space defined between the retaining member and a crest of the slope with soil. The crest of the slope thus provides a broad stable base for supporting for example a roadway or a railway thereon.

The retaining member may be anchored with a plurality of soil nails coupled thereto, wherein each soil nail is penetrated into the slope.

A plate member may be mounted on each soil nail adjacent one end thereof and orienting the soil nails before penetration into the slope so that plate extends transversely to the slope.

The plate members on the soil nails are preferably oriented to lie in a substantially common plane therewith such that the plate members extend perpendicularly to the slope when the soil nails are penetrated perpendicularly into the surface of the slope.

According to a further aspect of the present invention there is provided a stabilisation system for stabilising soil within a slope having generally less than 45 degrees of inclination from horizontal, said system comprising:

a plurality of soil nails, each having a soil penetrating end for penetrating into the soil and a surface engaging end for engaging a top surface of the soil; and a biotechnical facing arranged to cover the top surface of the soil.

The biotechnical facing preferably comprises a mass of organic fibres having a root structure arranged to penetrate into the soil.

There may be provided a geosynthetic layer comprising a mat, mesh or fibrous material arranged on or near the surface to further reinforce the surface and assist in establishing the mass of organic fibres thereon.

A retaining wall structure may be mounted on the slope to extend longitudinally along a crest of the slope.

In one arrangement of the present invention, the retaining wall comprises:

a pair of retaining members mounted spaced apart on a crest of the slope to extend longitudinally with the crest; and a plurality of cross members, each being connected between the pair of retaining members for mounting the retaining members parallel and spaced apart in relation to one another.

Alternatively the retaining wall structure may comprise an elongate plate member oriented perpendicularly to the surface of the soil to project outwardly therefrom.

There may be provided a filler material located within a spaced defined between the retaining wall structure and the crest of the slope. The filler material may comprise gravel or the like to provide a stable base while permitting drainage therethrough at the crest of the slope.

There may be provided a plurality of soil nails which are penetrated in the soil and coupled to the retaining wall structure for anchoring the retaining wall structure adjacent the crest of the slope.

There may be provided a soil retaining plate member mounted on the surface engaging end of the each soil nail for engaging and retaining the soil adjacent the surface of the slope.

The soil retaining plates are preferably mounted on each soil nail to lie in a substantially common plane therewith such that the plates are oriented perpendicularly to the slope when the soil nails are penetrated into the soil perpendicularly to the surface thereof.

BRIEF DESCRIPTION OF THE DRAWINGS

In the accompanying drawings, which illustrate exemplary embodiments of the present invention.

DETAILED DESCRIPTION

Figure 1:
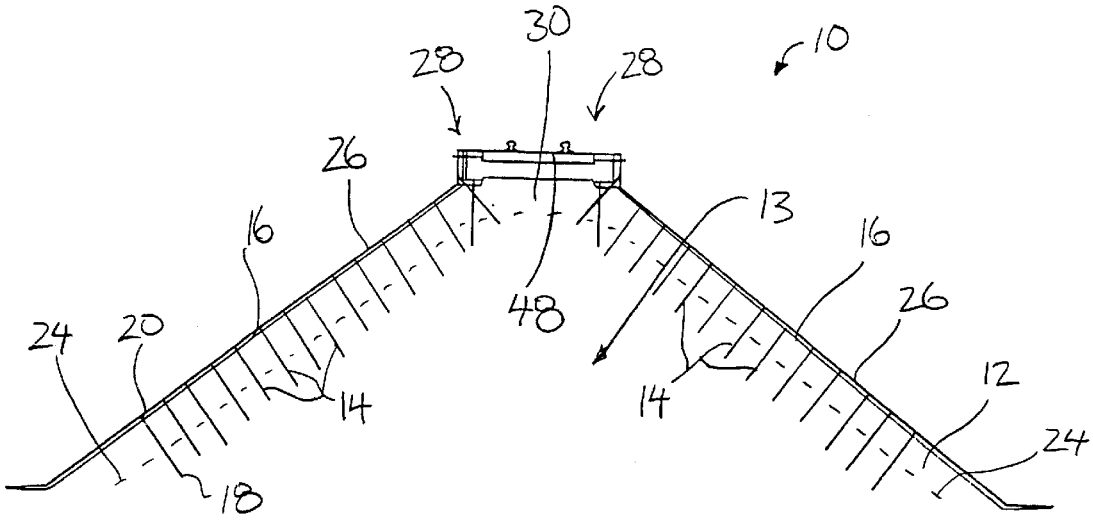
FIG. 1 is a cross sectional view of a soil slope with the stabilisation system thereon.
Figure 2:
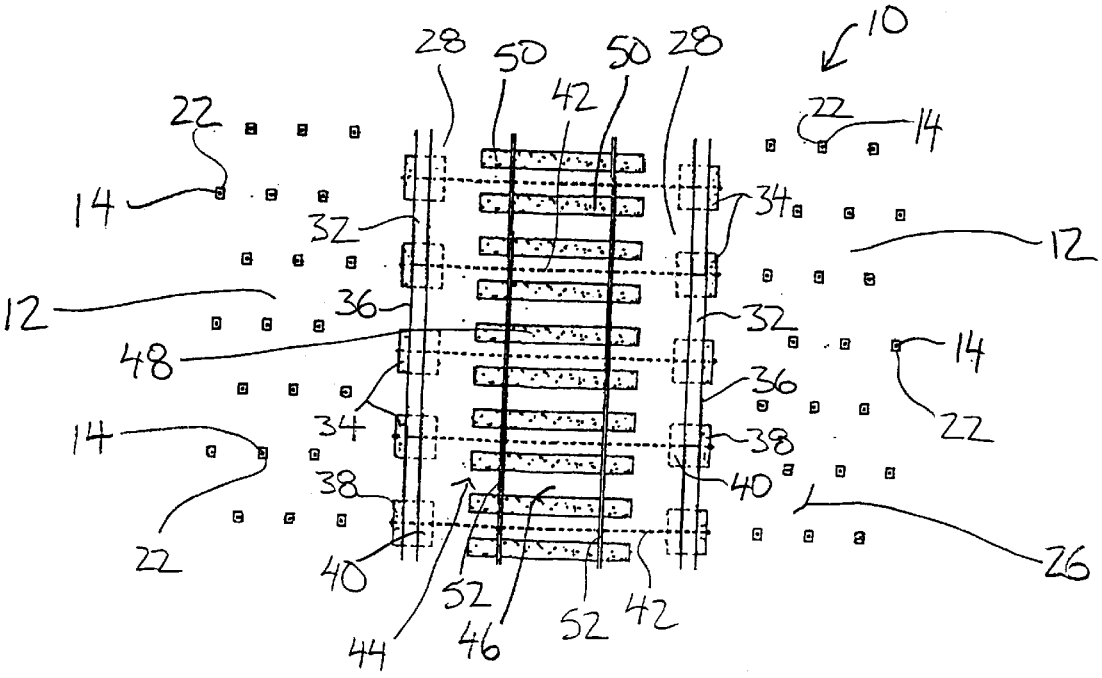
FIG. 2 is top plan view of the stabilisation system.
Figure 3:
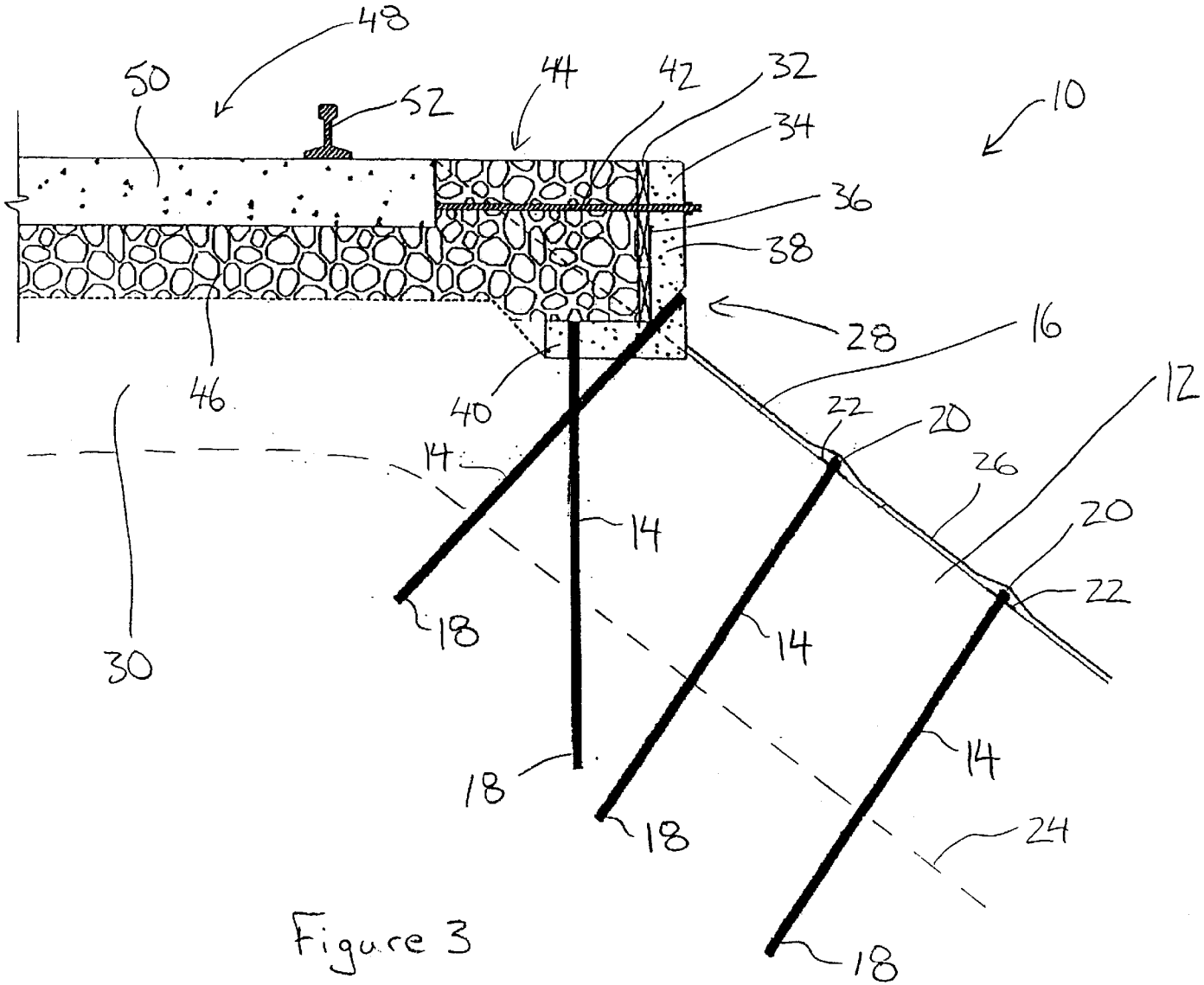
FIG. 3 is an enlarged view of a portion of FIG. 1.

Referring to the accompanying drawings, there is illustrated a stabilisation system generally indicated by reference numeral 10 for stabilising soil slopes of a railway embankment. The system 10 is adapted for installation on existing slopes 12 of an embankment 13 for stabilising the internal soil of the slopes and for preventing erosion at the surface or near the surface of the soil. The system is particularly suitable for use on slopes having generally less than 45 degrees of inclination from horizontal.

The system 10 includes a plurality of soil nails 14 which are penetrated into a top surface 16 of the slope in a staggered pattern. The nails 14 are elongate rigid members having any one of numerous different types of cross sections. The nails each include a penetrating end 18 arranged to penetrate into the soil and a surface engaging end 20 arranged to be secured against the top surface 16 of the slope.

The surface engaging end 20 includes a portion of increased dimension 22 at the surface 16 or near the surface of the soil. The nails extend through the soil past an existing or potential failure plane 24 in the soil for providing internal soil stability to the slope.

The nails are inserted into the soil by percussion, pushing, turning or vibrating. Alternatively, the nails may be inserted into pre-made holes. The nail strength, length, diameter and spacing are selected based upon the desired degree of improvement through an engineering design. Nails are typically 25 to 50 millimeters in diameter and 2 to 10 meters long.

A biotechnical facing consisting of vegetation and which may be combined with a geosynthetic layer 26, is placed across the top surface 16 of the soil and the surface engaging end of each nail for preventing shallow failure and erosion of surface soils. The geosynthetic layer is a manufactured mat, mesh or fibrous material, permanent or biodegradeable, of natural or synthetic materials, designed to reinforce the surface or assist growth and maintenance of vegetation. The use of a geosynthetic layer is a known practice in construction on soft terrain for adding structural support to the soil of the terrain. It provides an erosion resistant layer when combined with vegetation.

Vegetation is seeded or planted below or near the geosynthetic layer 26 such that the vegetation becomes well established and an organic mass of roots penetrates into the soil. The plant root mass is selected based on the desired degree of improvement through engineering design. The vegetation is typically selected to extend to a depth of 100 to 400 millimeters into the soil.

A retaining wall structure 28 is mounted on each slope 12 of the embankment adjacent a crest 30 of the embankment to stabilise the shoulder of the embankment near the crest 30. Each retaining wall structure 28 includes elongate timbers 32 extending longitudinally along the embankment adjacent the crest so as to extend transversely to the slope.

The timbers 32 are parallel and spaced apart along the crest. A plurality of concrete anchors 34 are mounted along an outer face 36 of the timbers 32 for securing the timbers in place. Each anchor is an L-shaped member having an upright portion 38 engaging the outer face of the timber and a lateral portion 40 extending laterally inward adjacent a bottom face of the timber. A pair of the soil nails 14 are inserted through respective apertures in each anchor 34 for securing the anchor to the embankment at spaced positions along the timber.

Each anchor 34 is secured to a corresponding one of the anchors adjacent the opposing timber 32 by a rod 42. Each rod 42 is fastened to the corresponding pair of anchors 34 at respective ends of the rod.

A space 44 defined between the timbers is filled with gravel 46 to allow drainage of water and prevent water collection at the crest of the embankment. The gravel 46 surrounds the rods 42 extending across the space 44 between corresponding anchors 34.

A railway 48 is mounted on the crest of the embankment. The railway 48 includes a plurality of rail ties 50 embedded into the gravel. The rail ties 50 are parallel and spaced apart along the crest of the embankment. A pair of rails 52 are mounted on the rail ties 50 parallel and spaced apart.

Figure 4:
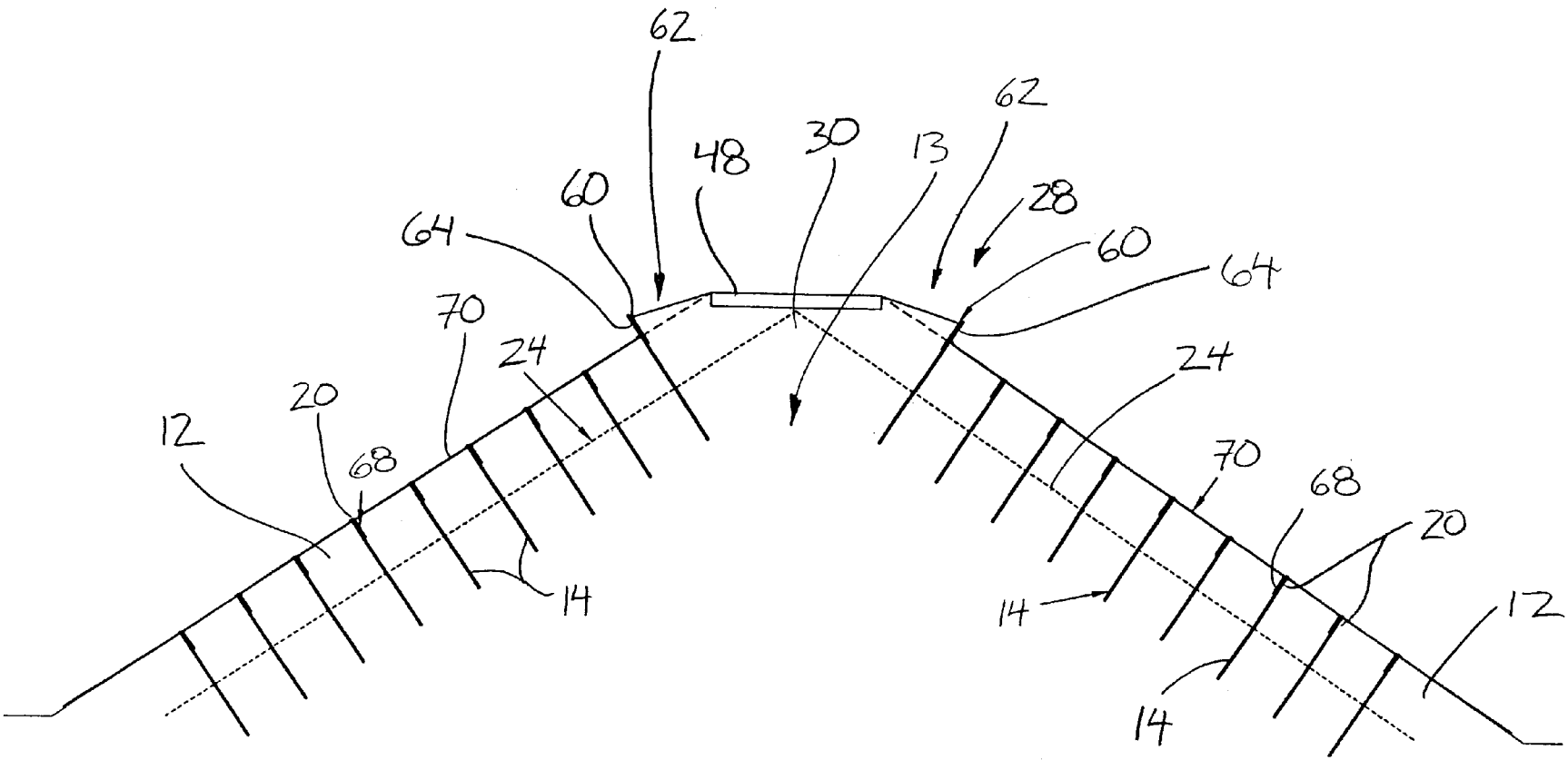
FIG. 4 is a cross sectional view of a soil slope with an alternative embodiment of the stabilisation system thereon.
Figure 5:
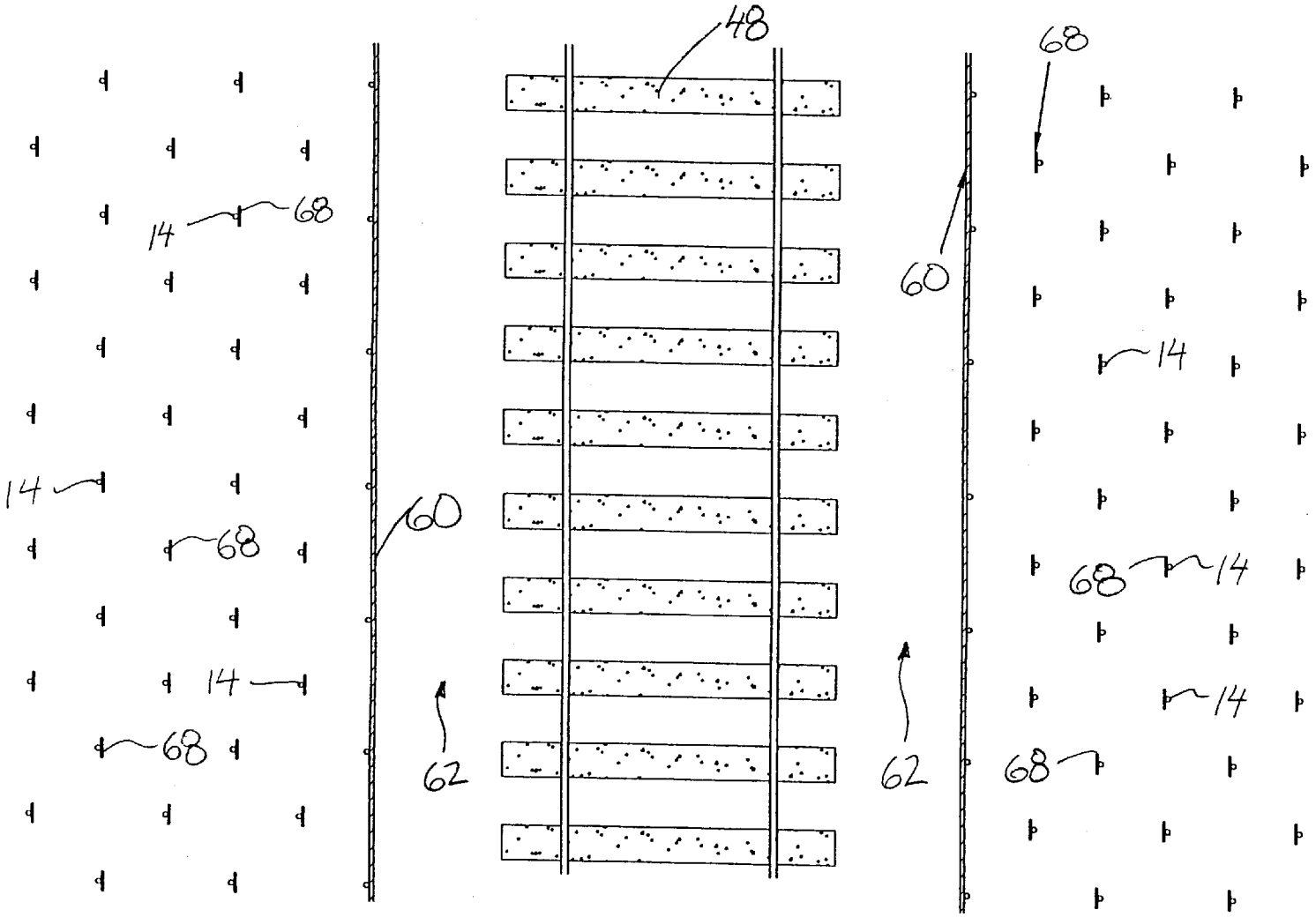
FIG. 5 is a top plan view of the stabilisation system of FIG. 4.
Figure 6:
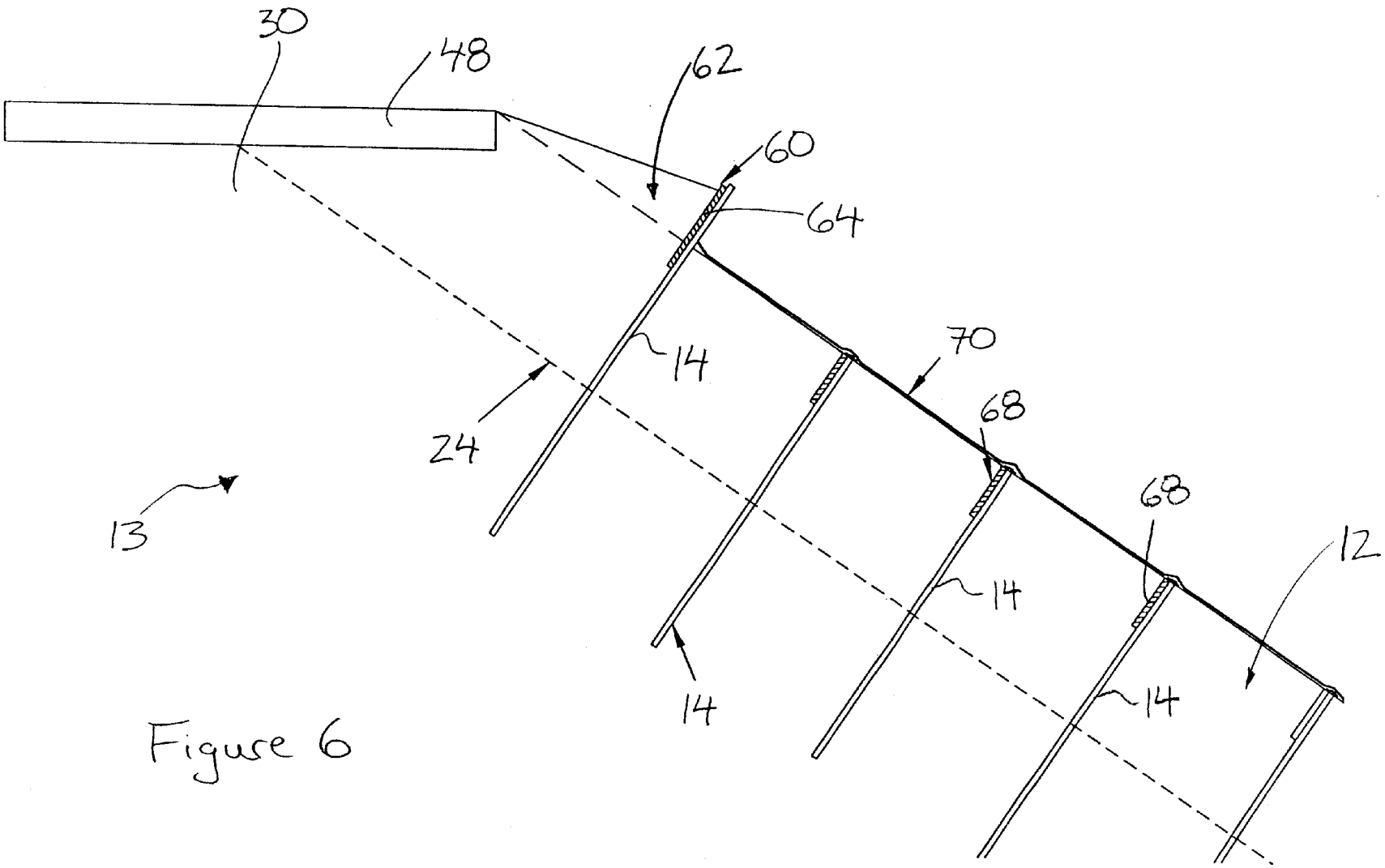
FIG. 6 is an enlarged view of a portion of FIG. 4.

In an alternate embodiment of the present invention, illustrated in FIGS. 4 through 6, a plurality of the soil nails 14 are penetrated at staggered and spaced intervals into the surface of the slopes 12 of the embankment 13 similarly to the first embodiment. In the alternate embodiment, the retaining wall structure 28 comprises a pair of elongate retaining members 60 which are mounted parallel and spaced apart to extend longitudinally with the crest 30.

Each retaining member 60 is a continuous flat strip of material, for example a timber or steel lagging. A plurality of the soil nails 14 are secured to each retaining member 60 for mounting the retaining member to extend substantially perpendicularly to the surface of the slope and project outwardly therefrom.

The railway 48 is supported on the crest 30 of the embankment, spaced between the retaining members 60 to extend longitudinally therewith along the crest. A space 62 defined between a free end 64 of each retaining member 60 and the railway 48 is levelled with soil.

The portion of increased diameter 22 at the surface engaging end of each soil nail 14 in the alternative embodiment, comprises a soil retaining plate 68 mounted on the soil nail so as to be located perpendicular to and adjacent to the surface of the slope 12 in which the soil nail is penetrated. The plates 68 are oriented on the respective nails to lie in a substantially common plane therewith such that the plates lie perpendicularly to the slope when the soil nails are penetrated into the soil perpendicularly to the surface thereof. The soil nails are penetrated into the slope before a biotechnical facing having a geosynthetic layer 70 similar to the first embodiment, is laid across the surface on the slopes 12 over the surface engaging ends 20 of the nails 14 as shown in detail in FIG. 6.

The geosynthetic layer 70 is a manufactured mat, mesh or fibrous material which provides structural support to the soil of the slope and assists vegetation to be established below the facing such that the organic mass of roots of the vegetation penetrates into the soil once the vegetation becomes well established. Thus, similarly to the first embodiment, the soil nails extend through the soil past an existing or potential failure plane 24 to provide internal soil stability to the slope while the biotechnical facing 70 along with the vegetation seeded at the surface of the slope prevents erosion or shallow failure near the surface of the slopes. Additionally, the retaining members 60 inhibit soil erosion and shallow failure at the crest of the embankment.

While various embodiments of the present invention have been described in the foregoing, it is to be understood that other embodiments are possible within the scope of the invention. The invention is to be considered limited solely by the scope of the appended claims.

What is claimed is:

1. A method for stabilising soil within a slope having a surface lying less than 45 degrees of inclination from horizontal and a failure plane below a surface of the soil, said method comprising:

providing a plurality of soil nails;

stabilising the internal soil of the slope by penetrating the plurality of soil nails into the soil across the failure plane of the slope;

establishing vegetation adjacent the surface of the slope, the vegetation being arranged to generate roots which penetrate through the surface into the soil;

mounting a retaining member in the form of an elongate plate member adjacent a crest of the slope; and orienting the plate member to extend substantially perpendicularly to the surface of the soil.

2. The method according to claim 1 including placing a geosynthetic layer adjacent the surface of the slope in a manner such that the vegetation is stabilised on the surface of the slope for retaining the soil adjacent the surface of the slope.

3. The method according to claim 1 including supporting the retaining member on the surface of the soil to project outwardly therefrom.

4. The method according to claim 3 including filling a space defined between the retaining member and the crest of the slope with filler material.

5. The method according to claim 1 including anchoring the retaining member to the slope with a plurality of soil nails coupled to the retaining member, wherein each soil nail is penetrated into the slope.

6. The method according to claim 1 including providing a soil retaining plate mounted on each soil nail and orienting the soil retaining plates transversely to the surface of the slope in a crosswise intersecting manner as the soil nails are penetrated into the soil.

7. The method according to claim 6 including orienting the soil nails before penetration into the slope so that the soil retaining plate of each soil nail extends perpendicularly to the surface of the slope adjacent the surface of the slope.

8. The method according to claim 6 including mounting the soil retaining plate of each soil nail to lie in a substantially common plane with the respective soil nail and penetrating the soil nails into the slope perpendicularly to the surface of the slope.

9. A stabilisation system in combination with a slope for stabilising soil within the slope, the slope having a surface lying less than 45 degrees of inclination from horizontal, said system comprising:

a plurality of soil nails, each being generally greater than 2 meters in length and having a soil penetrating end penetrated into the slope and a surface engaging end engaged at the surface of the slope;

the surface engaging end of each soil nail including a plate-like soil retaining member mounted thereon lying in a substantially common plane with the soil nail and which penetrated into the slope with the respective soil nail, the soil retaining member lying transversely to the surface of the slope in a crosswise intersecting manner so as to retain soil at the surface of the slope; and an organic facing adjacent the surface of the slope.

10. The combination according to claim 9 wherein the organic facing comprises a mass of organic fibres having a root structure arranged to penetrate into the soil of the slope.

11. The combination according to claim 10 wherein there is provided a geosynthetic layer adjacent the surface of the slope arranged to support the surface of the slope and establish the mass of organic fibres thereon.

12. A stabilisation system for stabilising soil within a slope having a crest along a top of the slope and a surface lying less than 45 degrees of inclination from horizontal, said system comprising:

a plurality of soil nails, each having a soil penetrating end for penetrating into the slope and a surface engaging end for engaging the surface of the slope;

the surface engaging end of each soil nail including a soil retaining plate mounted thereon which is arranged to be penetrated into the slope with the respective soil nail with the soil retaining plate lying transversely to the surface of the slope in a crosswise intersecting manner;

a retaining wall structure arranged to be mounted on the slope to extend in a longitudinal direction of the wall structure along the crest of the slope adjacent the top of the slope, the retaining wall structure comprising an elongate plate member oriented transversely to the surface of the slope in a crosswise intersecting manner;

and an organic facing adjacent the surface of the slope.

13. The system according to claim 12 wherein the retaining wall structure comprises:

a pair of retaining members mounted spaced apart at the crest of the slope to extend longitudinally with the crest; and a plurality of cross members, each being connected between the pair of retaining members for mounting the retaining members parallel and spaced apart in relation to one another.

14. The system according to claim 12 wherein elongate plate member is oriented perpendicularly to the surface of the slope.

15. The system according to claim 12 wherein the elongate plate member projects outwardly from the surface of the slope.

16. The system according to claim 15 wherein there is provided a filler material occupying a space defined between the retaining wall structure and the crest of the slope.

17. The system according to claim 12 wherein there is provided a plurality of soil nails which are penetrated into the soil and coupled to the retaining wall structure so as to anchor the retaining wall structure adjacent the crest of the slope.

18. The system according to claim 12 where in the soil retaining plate mounted on the surface engaging end of each soil nail lies in a substantially common plane with the respective soil nail such that the soil retaining plates are oriented perpendicularly to the slope when the soil nails are penetrated into the slope perpendicularly to the surface of the slope.

* * * * *